US006549170B1

(12) United States Patent
Kuo et al.

(10) Patent No.: US 6,549,170 B1
(45) Date of Patent: Apr. 15, 2003

(54) INTEGRATED DUAL-POLARIZED PRINTED MONOPOLE ANTENNA

(75) Inventors: Yen Liang Kuo, Tainan (TW); Kin Lu Wong, No. 70, Lianhai Rd., Gushan Chiu, Kaohsiung (TW)

(73) Assignees: Accton Technology Corporation (TW); Kin Lu Wong (TW)

( * ) Notice: Subject to any disclaimer, the term of this patent is extended or adjusted under 35 U.S.C. 154(b) by 0 days.

(21) Appl. No.: 10/046,225

(22) Filed: Jan. 16, 2002

(51) Int. Cl.[7] ..... H01Q 1/38

(52) U.S. Cl. ..... 343/702; 343/795; 343/846; 343/700 MS

(58) Field of Search ..... 343/702, 700 MS, 343/795, 797, 846, 848, 829, 841, 826; H01Q 1/38

(56) References Cited

U.S. PATENT DOCUMENTS 5,990,838 A 11/1999 Burns et al. ..... 343/702
6,356,242 B1 * 3/2002 Ploussios ..... 343/795
6,396,456 B1 * 5/2002 Chiang et al. ..... 343/795

* cited by examiner

*Primary Examiner*—Hoanganh Le

(57) ABSTRACT

An integrated dual-polarized printed monopole antenna includes a microwave substrate having a first surface and a second surface; a first monopole antenna disposed on the first surface of the substrate and excited by a first microstrip line through a first feeding port; a second monopole antenna disposed on the first surface of the substrate and excited by a second microstrip line through a second feeding port, and the first antenna being mutually perpendicular to the second antenna; and a metallic ground plane disposed on the second surface of the substrate, the metallic ground plane having a main metallic ground plane and a protruded metallic ground plane extending between the first and the second antenna.

10 Claims, 7 Drawing Sheets

(a)

(b)

INTEGRATED DUAL-POLARIZED PRINTED MONOPOLE ANTENNA

BACKGROUND OF THE INVENTION

1. Field of the Invention

The present invention relates to an antenna system, and more particularly to an integrated dual-polarized printed monopole antenna for WLAN (wireless local area network) application, providing polarization diversity to combat multipath fading effect in wireless communication system.

2. Description of the Related Art

With the prosperous development in wireless communications, the users also become very demanding in communication quality. It is required that the communication products be thinner, lighter, shorter and smaller, and stable communication quality is also a big concern. However, the multipath fading effect significantly reduces the communication quality of the system. Accordingly, it is necessary to employ antenna diversity to combat the multipath fading effect in wireless communication system.

Generally speaking, conventional antenna diversity can be accomplished in the form of frequency diversity, time diversity, or spatial diversity. In frequency diversity, the system switches between frequencies to combat multipath fading effect. In time diversity systems, the signal is transmitted or received at two different times to combat multipath fading effect. In spatial diversity systems, two or more antennas are placed at physically different locations to combat multipath fading effect.

U.S. Pat. No. 5,990,838, issued to Burns et al. on Nov. 23, 1999 entitled "Dual Orthogonal Monopole Antenna System," discloses a spatial diversity antenna system having a pair of monopole antennas respectively disposed on the top and bottom surfaces of the printed circuit board which has a first and a second dielectric layers, a conducting ground plane disposed between the first and second dielectric layers, wherein the pair of antennas are mutually orthogonal, and a feeding circuit is coupled to the pair of antennas for connecting to a principal system.

Although U.S. Pat. No. 5,990,838 has provided an antenna system of spatial diversity to improve the multipath fading effect in wireless communication system, it still fails to obtain optimal reflection coefficient ($S_{11}$) and isolation ($S_{21}$) for combating the multipath fading effect. Furthermore, U.S. Pat. No. 5,990,838 needs to use multilayer printed substrate, which requires a complex structure and high fabrication cost.

Therefore, it is necessary to provide an antenna system for effectively solving the problems of conventional art mentioned above, so as to obtain optimal reflection coefficient ($S_{11}$) and isolation ($S_{21}$) for combating the multipath fading effect in wireless communication system.

SUMMARY OF THE INVENTION

It is a primary object of the present invention to provide an integrated dual-polarized printed monopole antenna having optimal reflection coefficient ($S_{11}$) and isolation ($S_{21}$) to combat the multipath fading effect in wireless communication system.

It is another object of the present invention to provide an integrated dual-polarized printed monopole antenna with polarization diversity to combat the multipath fading effect in wireless communication system.

It is a further object of the present invention to provide an integrated dual-polarized printed monopole antenna which has a simple structure and can be fabricated at lower cost.

In order to achieve the above objects, the present invention provides an integrated dual-polarized printed monopole antenna mainly comprising:

a microwave substrate having a first and a second surfaces; a first monopole antenna disposed on the first surface of the substrate and excited by a first 50-Ω microstrip line through a first feeding port; a second monopole antenna disposed on the first surface of the substrate and excited by a second 50-Ω microstrip line through a second feeding port, and the second monopole antenna being mutually perpendicular to the first monopole antenna; and a metallic ground plane disposed on the second surface of the substrate, the metallic ground plane having a main metallic ground plane and a protruded metallic ground plane extending between the first and the second monopole antennas.

According to another aspect of the present invention, the main metallic ground plane is rectangular or substantially rectangular shape, wherein two adjacent corners thereof are respectively cut off a 45° edge portion, and the lengths of the two cut edge portions are the same.

According to a further aspect of the present invention, both the first and the second monopole antennas are straight radiating metallic lines of same length, and are resonant at quarter-wavelength, and extend outwardly respectively at 90° on the two cut edge portions of the main metallic ground plane.

According to a still further aspect of the present invention, the protruded metallic ground plane is rectangular or substantially rectangular, wherein one side thereof extends from the main metallic ground plane between the two cut edge portions, and the length thereof is about 1.5 times of the first and second monopole antennas, and the width thereof is about 0.8 times of the first and second monopole antennas.

According to the present invention, the protruded metallic ground plane is capable of effectively reducing the coupling between two monopole antennas to obtain better isolation and impedance matching. The experimental results of an antenna design embodiment of the present invention for WLAN application at 2.4-GHz band show that employing the protruded metallic ground plane for the operating frequencies within the WLAN band (2400–2484 MHz) can make the isolation of the two monopole antennas less than −27 dB. In addition, the measured radiation pattern in the embodiment also shows that the antenna has good dual-polarized radiation characteristics. The antenna according to the present invention has a simple structure, small volume, and is very easy to implement, to integrate with related circuits, and suitable for applications in WLAN (wireless local area network) systems.

DETAILED DESCRIPTION OF PREFERRED EMBODIMENTS

Figure 1:
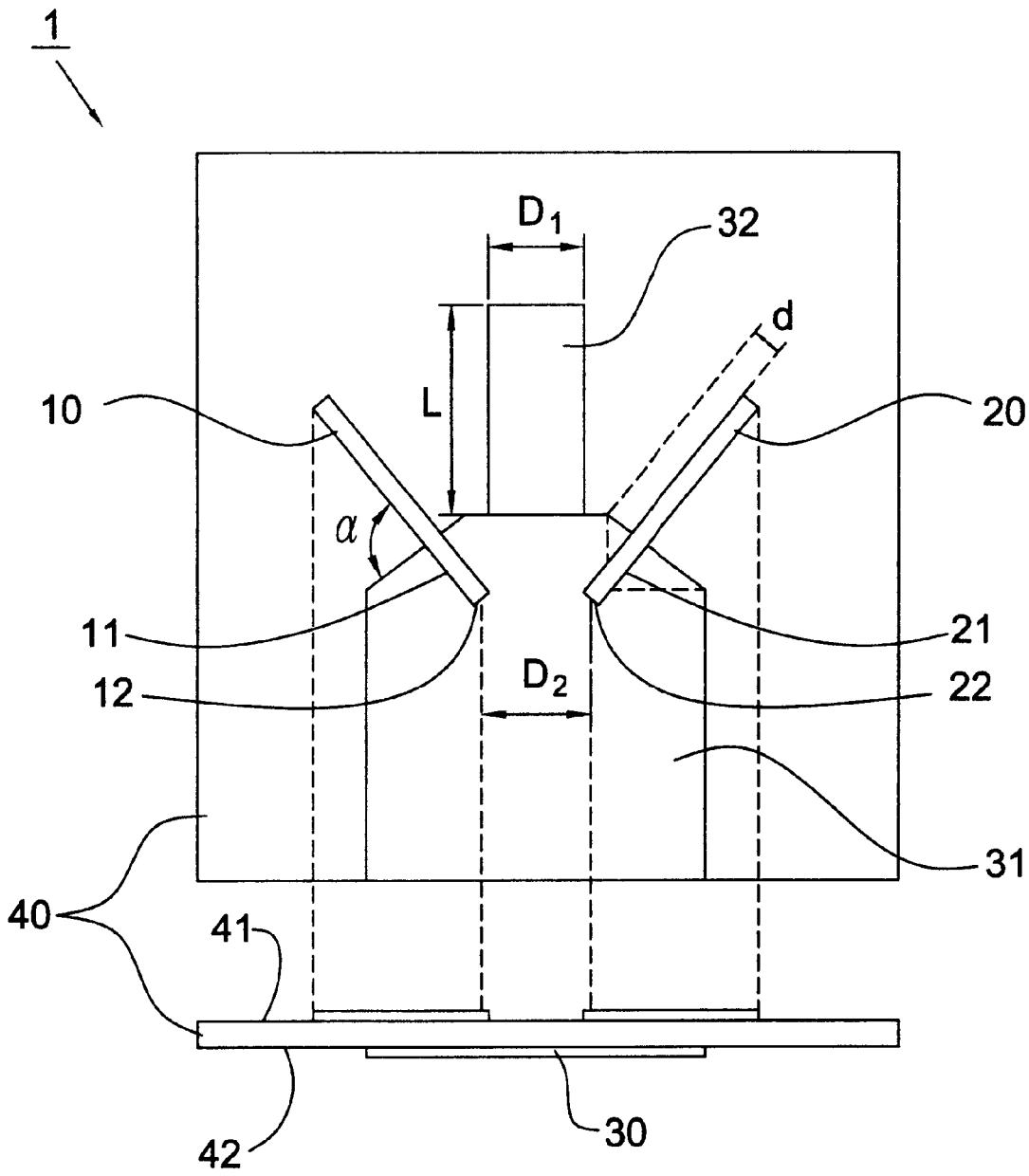
FIG. 1 is a structure diagram of an integrated dual-polarized printed monopole antenna of the present invention.

While the present invention is susceptible of embodiment in various forms, there is a presently preferred embodiment shown in the drawings and will hereinafter be described with the understanding that the present disclosure is to be considered as an exemplification of the invention and is not intended to limit the invention to the specific embodiment illustrated.

FIG. 1 shows that an integrated dual-polarized printed monopole antenna 1 mainly comprising a microwave substrate 40, a first monopole antenna 10, a second monopole antenna 20, and a main metallic ground plan 31. The microwave substrate 40 has a first surface 41 (top surface) and a second surface 42 (bottom surface), wherein the first monopole antenna 10 and the second monopole antenna 20 are disposed on the first surface 41 of the microwave substrate 40, and are mutually orthogonal, and the main metallic ground plane 31 is disposed on the second surface 42 of the microwave substrate 40, and has a protruded metallic ground plane 32 extending between the first monopole antenna 10 and second monopole antenna 20.

The microwave substrate 40 is generally a printed circuit board manufactured by BT (bismaleimide-triazine) or FR4 (fiberglass reinforced epoxy resin), or a flexible film substrate made of polyimide in accordance with the present invention. The first monopole antenna 10 and the second monopole antenna 20 are printed on the first surface 41 of the microwave substrate 40, and the main metallic ground plane 31 is printed on the second surface 42 of the microwave substrate 40. The main metallic ground plane 31 is preferably rectangular or substantially rectangular, and the protruded metallic ground plane 32 is also rectangular or substantially rectangular. In addition, in order to dispose both the monopole antennas 10 and 20 respectively at an angle ($\alpha$) orthogonal (90°) to the edge of the main metallic ground plane 31, the two corners of the main metallic ground plane 31 are cut off a 45° section, and the radiating metallic lines of the monopole antennas 10 and 20 are also disposed orthogonal to the edges of the corners. The first and the second monopole antennas 10 and 20 are excited respectively at a first feeding port 12 and a second feeding port 22 through a first microstrip feeding line 11 and a second microstrip feeding line 21, wherein the first microstrip feeding line 11 and the second microstrip feeding line 21 are preferably 50-Ω microstrip lines. Both monopole antennas 10 and 20 are the straight radiating metallic lines of same lengths, resonant at quarter-wavelength, and symmetric about the protruded metallic plane 32. The protruded metallic plane 32 can effectively reduce the coupling between the two monopole antennas. With suitably tuning the length L and the width $D_1$ of the metallic ground plane and the position that the monopole antenna is placed (the distance d between the monopole antenna and the cut edge of the main metallic ground plane), an optimal isolation ($S_{21}$) can be obtained so as to significantly reduce the mutual coupling between the two monopoles.

Figure 2:
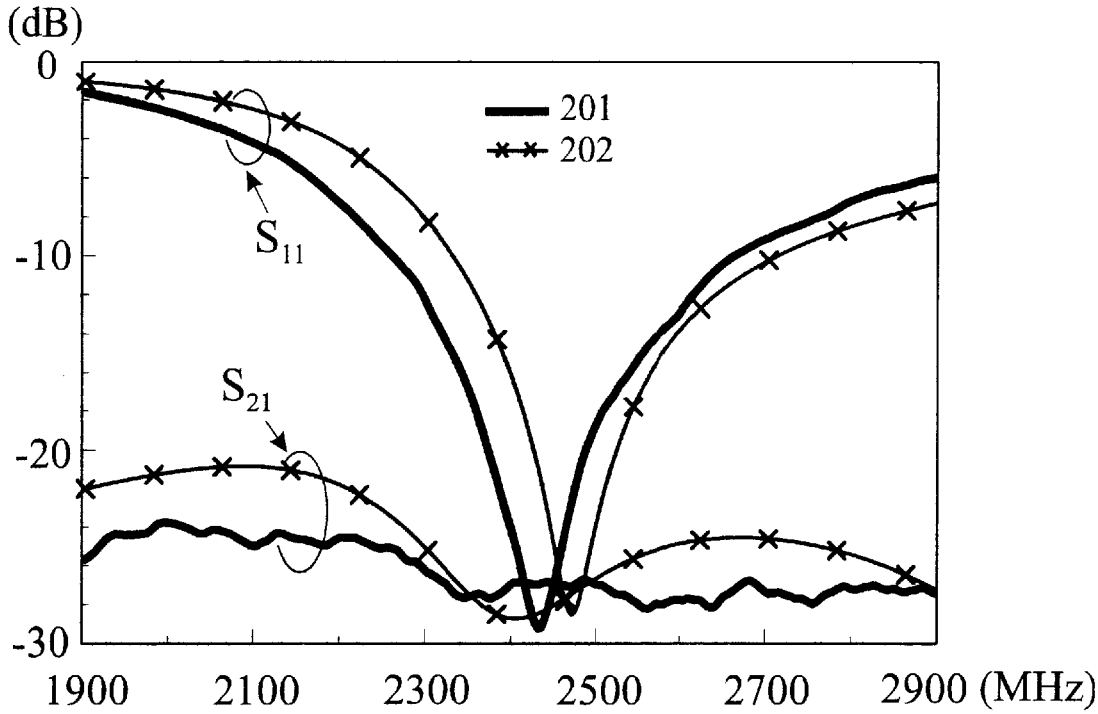
FIG. 2 is the experimental and simulated results of reflection coefficient ($S_{11}$) and isolation ($S_{21}$) of the present invention.
Figure 3:
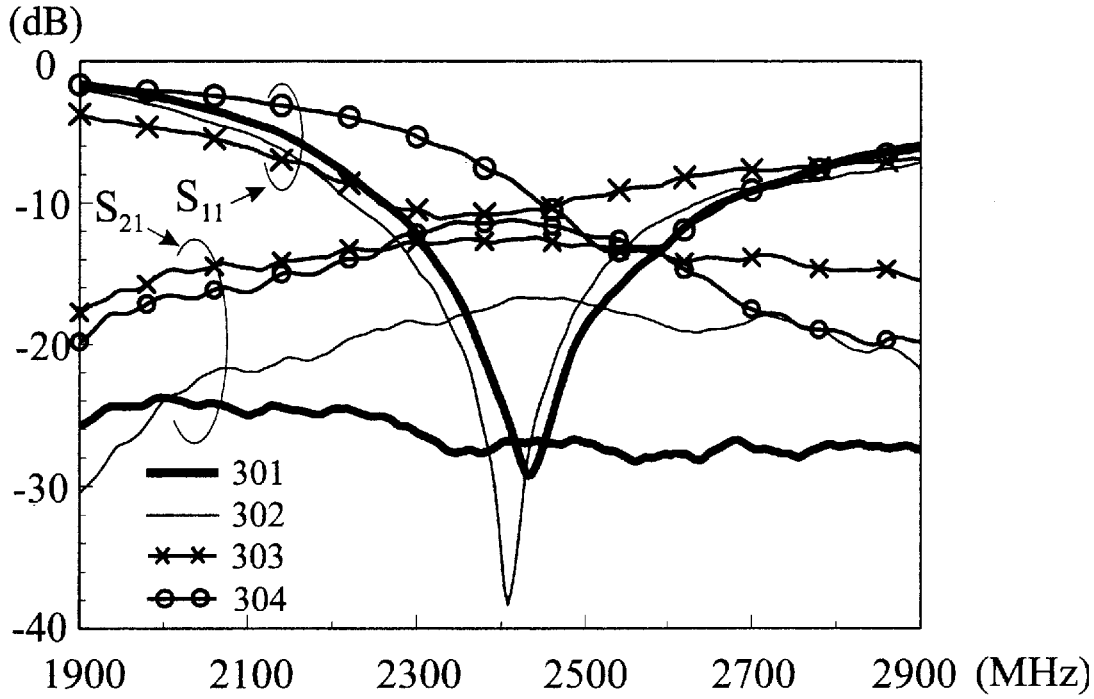
FIG. 3 is the experimental results of reflection coefficient ($S_{11}$) and isolation ($S_{21}$) with the width of the protruded metallic ground plane of the antenna being fixed, and the length being varied.
Figure 4:
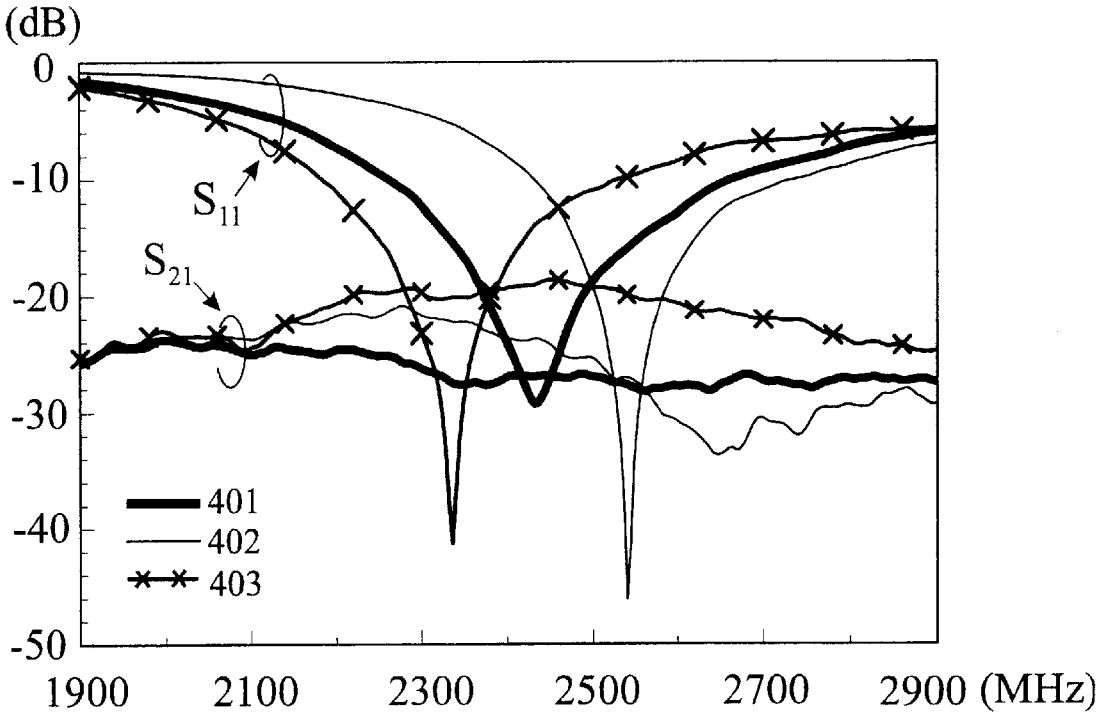
FIG. 4 is the experimental results of reflection coefficient ($S_{11}$) and isolation ($S_{21}$) with the length of the protruded metallic ground plane of the antenna being fixed, and the width being varied.
Figure 5:
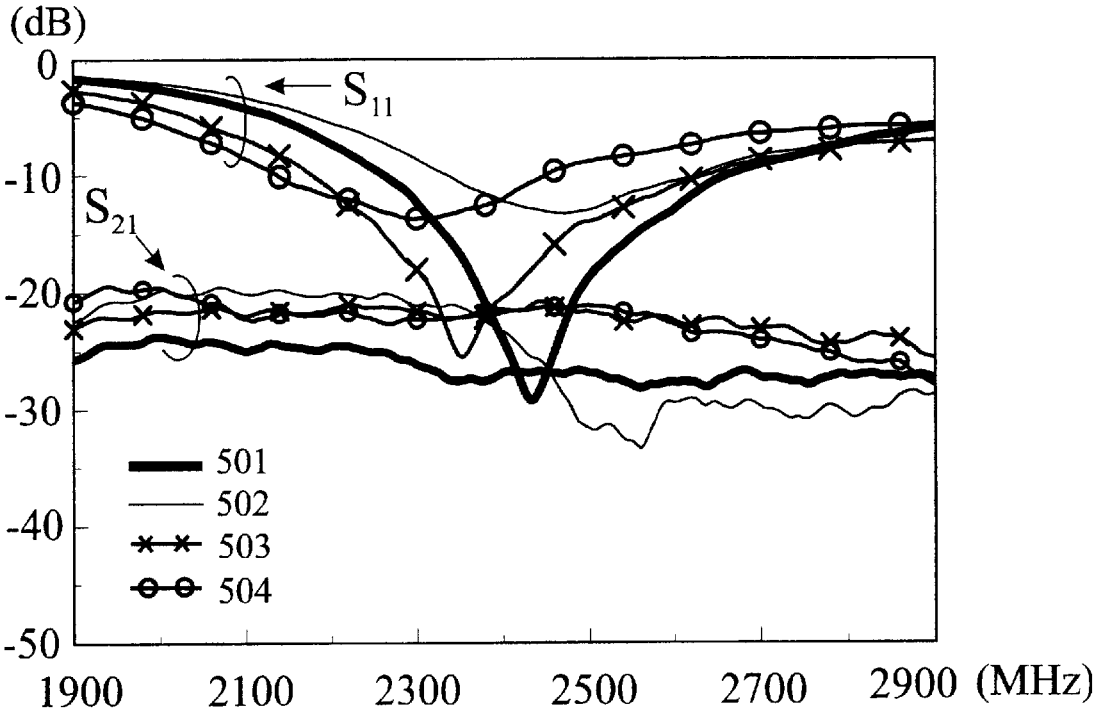
FIG. 5 is the experimental results of reflection coefficient ($S_{11}$) and isolation ($S_{21}$) with the length and width of the protruded metallic ground plane of the antenna being fixed, and the position of the monopole antenna being varied.

In accordance with the present invention, the measured results of the integrated dual-polarized printed monopole antenna 1 are shown in FIG. 2 to FIG. 8. The measured curve 201 and the simulated curve 202 of the reflection coefficient $S_{11}$ and isolation $S_{21}$ of the present antenna are shown in FIG. 2. Proper dimension selection of the protruded metallic ground plane can result in an optimal isolation, and reasonable agreement between the measured data and the simulated results is obtained. At the same time, in the 2.4 GHz band (2400–2485 MHz) for WLAN application, the reflection loss of all frequencies is less than −20 dB, the impedance matching is greatly enhanced, and the isolation of both feeding ports is less than −27 dB, thereby providing better isolation. FIG. 3 to FIG. 5 illustrate the effect of various lengths L and widths $D_1$ of the protruded ground metallic plane 32, and various arrangements of the monopole antenna (the distance d between the monopole antenna and the cut corner edge of the main metallic ground plane) on the reflection coefficient and isolation of the protruded ground metallic plane 32.

In FIG. 3, curves 301, 302, 303 and 304 are the experimental results of various lengths of the protruded ground metallic plane respectively equal to 32, 44, 22 and 0 mm; wherein the result of the curve 301 (the same as the curve 201 in FIG. 2) is optimal, and the isolation of both feeding ports is the best; in this case, the length L is about 1.5 times of the length of the monopole antenna.

In FIG. 4, curves 401, 402, and 403 are the experimental results of various widths of the protruded ground metallic plane respectively equal to 17, 22, and 11 mm; wherein the result of the curve 401 (the same as the curve 201 in FIG. 2 and curve 301 in FIG. 3) is optimal, and the isolation of both feeding ports is the best; in this case, the length L is about 0.8 times of the length of the monopole antenna.

In FIG. 5, curves 501, 502, 503 and 504 are the experimental results of various arranged positions of the protruded ground metallic plane (the distance d between the monopole antenna and the cut corner edge of the main metallic ground plane respectively equal to 5, 2, 10 and 15 mm); wherein the result of the curve 501 (the same as the curve 201 in FIG. 2, curve 301 in FIG. 3 and curve 401 in FIG. 4) is optimal, and the isolation of both feeding ports is the best; in this case, the distance d is about 0.25 times of the length of the monopole antenna. In addition, the effect of various distances $D_2$ between both feeding ports on isolation is quite small.

Figure 6:
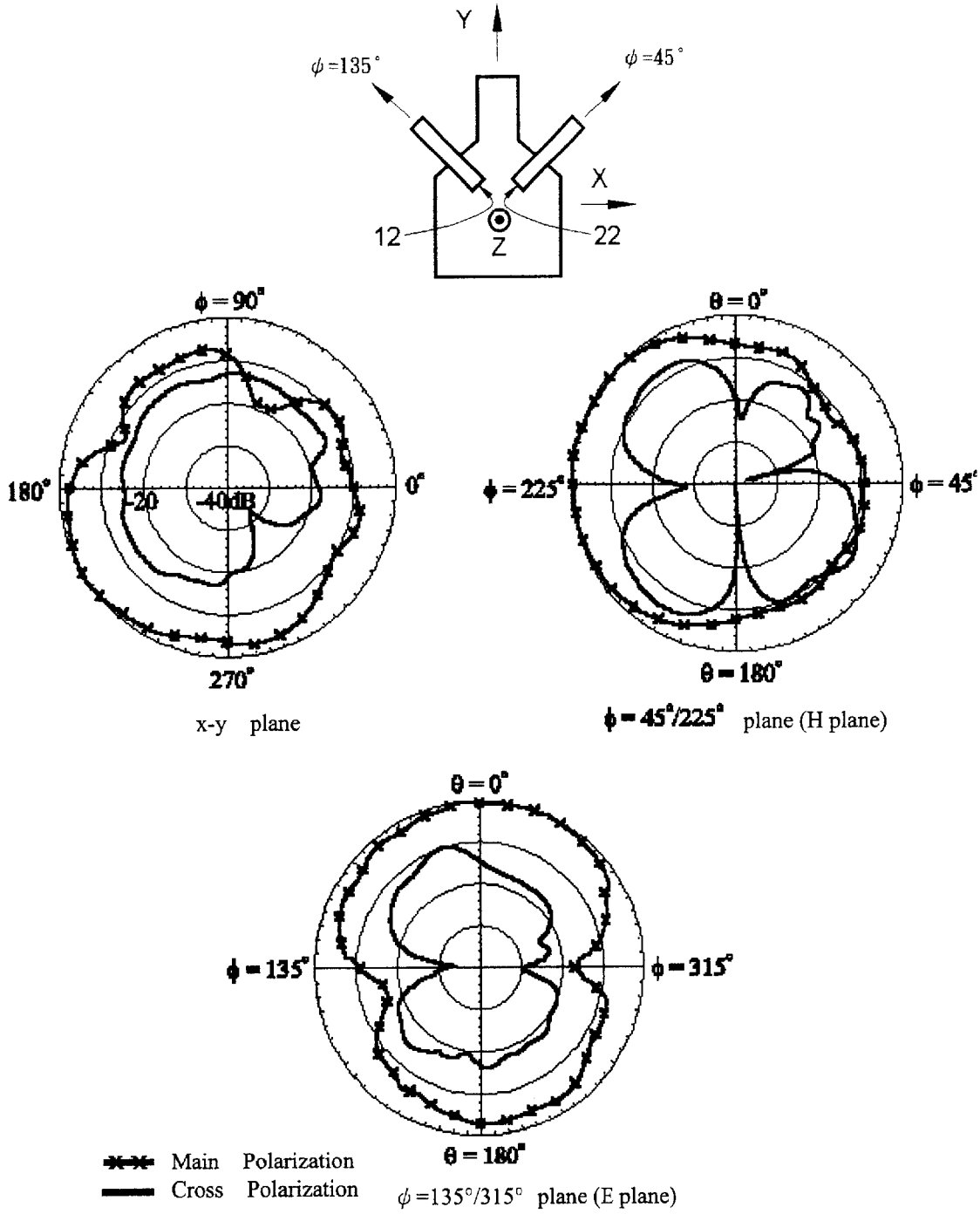
FIG. 6 is the experimental result of the radiation pattern of the first feeding port of the antenna at 2450 MHz.
Figure 7:
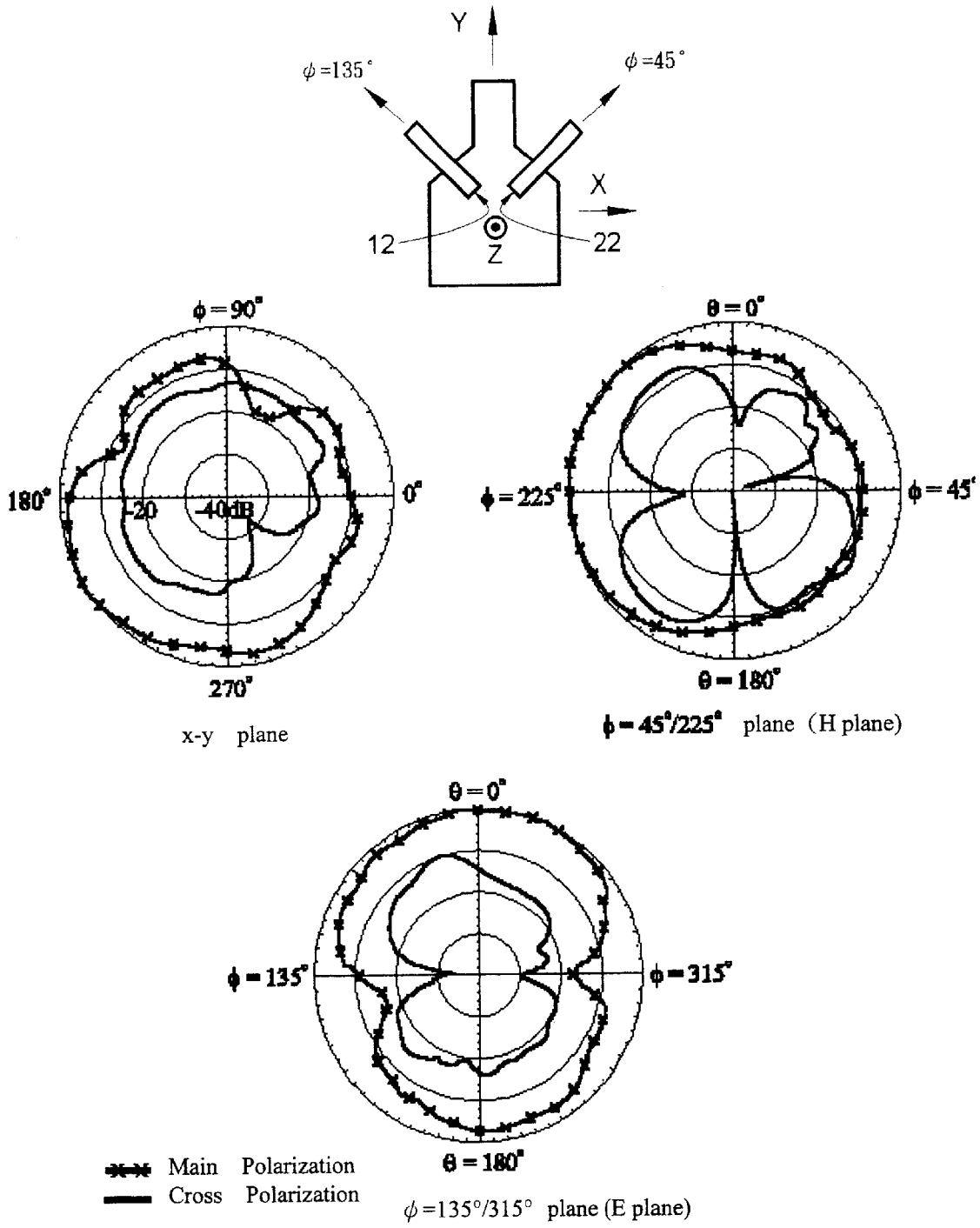
FIG. 7 is the experimental result of radiation pattern of the second feeding port of the antenna at 2450 MHz.
Figure 8:
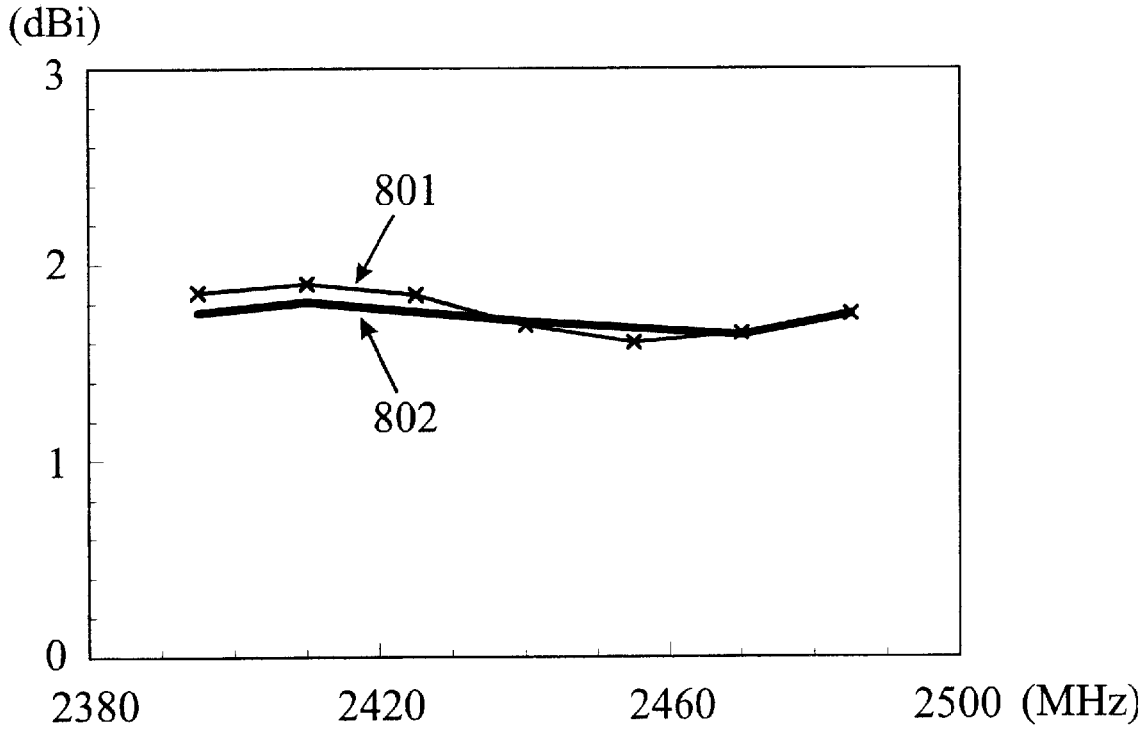
FIG. 8 is the experimental result of the antenna gain across the 2450 MHz band according to the antenna of the present invention.

FIG. 6 and FIG. 7 are the measured radiation pattern results of the first and second feeding ports at 2450 MHz; the radiation patterns of both feeding ports are symmetric observed from the above results, which together makes the proposed antenna with a wide radiation coverage. In addition, the E planes of both feeding ports are orthogonal to each other, so are the H planes of both feeding ports, which provides dual-polarized operation for the proposed antenna. FIG. 8 shows the measured antenna gain results of the present antenna operating in the 2450 MHz frequency band, which reveals that good antenna gain is obtained.

Figure 9:
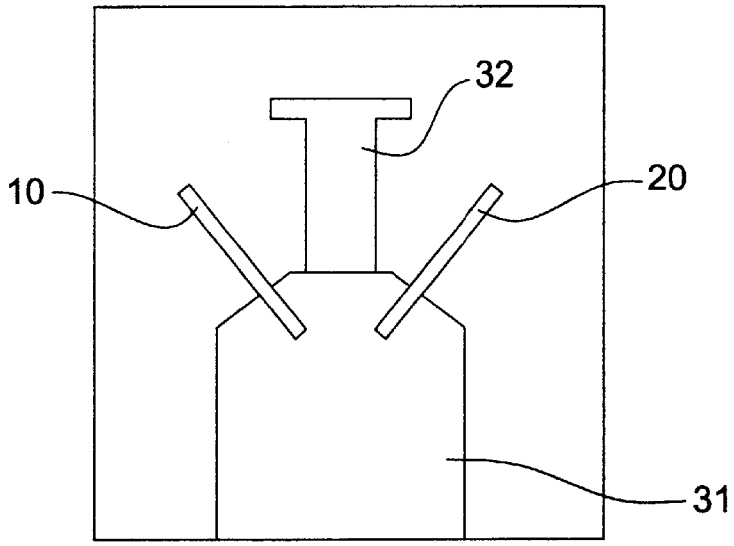
FIGS. 9*a* and 9*b* are the structure diagrams of other embodiments of the protruded metallic ground plane according to the antenna of the present invention.
Figure 9:
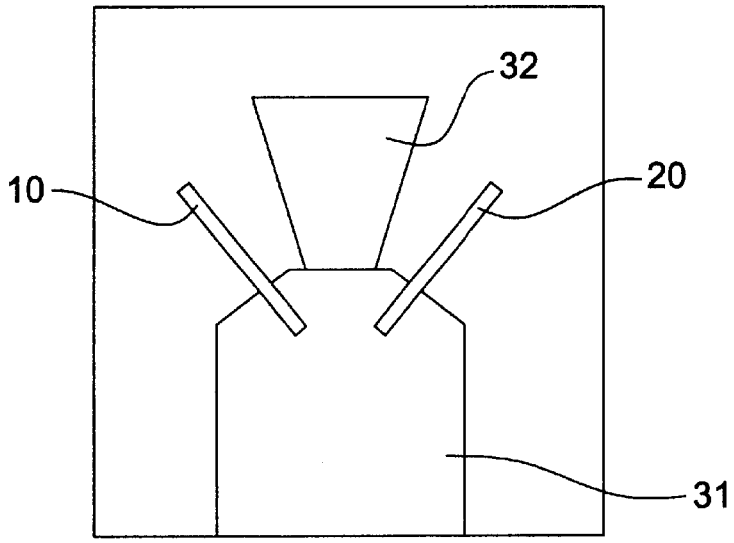

FIGS. 9*a* and 9*b* are the structure diagrams of the protruded metallic ground plane 32 of the present antenna employed in other embodiments. The protruded metallic ground plane is a T-shape or a trapezoid metallic ground plane of which one side is connected to the main metallic ground plane between the two corners thereof. The protruded ground metallic plane with proper dimensions also can effectively reduce the coupling between the two monopole antennas of the present invention, and obtain good isolation between two feeding ports and good impedance matching.

While the foregoing description and drawings represent the preferred embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure arrangement, proportions, materials, elements, and components and otherwise, used in the practice of the invention, which are particularly adapted to specific environments and operating requirements without departing from the principles of the present invention. The presently disclosed embodiments are therefore to be considered in all respects as illustrative and not restrictive, the scope of the invention being indicated by the appended claims and their legal equivalents, and not limited to be the foregoing description.

What is claimed is:

1. An integrated dual-polarized printed monopole antenna comprising:

a microwave substrate having a first surface and a second surface;

a first monopole antenna disposed on the first surface of the substrate and excited by a first microstrip line through a first feeding port;

a second monopole antenna disposed on the first surface of the substrate and excited by a second microstrip line through a second feeding port, and the first antenna being mutually perpendicular to the second antenna; and a metallic ground plane disposed on the second surface of the substrate, the metallic ground plane having a main metallic ground plane and a protruded metallic ground plane extending between the first and the second antenna.

2. The integrated dual-polarized printed monopole antenna as claimed in claim 1, wherein the main metallic ground plane is rectangular or substantially rectangular shape with two adjacent corners thereof respectively cut off a 45° edge portion.

3. The integrated dual-polarized printed monopole antenna as claimed in claim 1, wherein both the first and the second monopole antennas are straight radiating metallic lines of same length, and are resonant at quarter-wavelength, and extend outwardly respectively at 90° on the two cut edge portions of the main metallic ground plane.

4. The integrated dual-polarized printed monopole antenna as claimed in claim 3, wherein the first and the second monopole antennas are oriented symmetrically with respect to the protruded metallic ground plane.

5. The integrated dual-polarized printed monopole antenna as claimed in claim 1, wherein the protruded metallic ground plane is rectangular or substantially rectangular, wherein one side thereof extends from the main metallic ground plane between the two cut edge portions, and the length thereof is about 1.5 times of the first and second monopole antennas, and the width thereof is about 0.8 times of the first and second monopole antennas.

6. The integrated dual-polarized printed monopole antenna as claimed in claim 1, wherein the protruded metallic ground plane is the T-shaped or trapezoid metallic plane of which one side is connected to the main metallic ground plane between the two corners thereof.

7. The integrated dual-polarized printed monopole antenna as claimed in claim 1, wherein the first and the second microstrip feeding lines are 50-Ω microstrip lines.

8. An integrated dual-polarized printed monopole antenna comprising:

a microwave substrate having a first surface and a second surfaces;

a metallic ground plane disposed on the second surface of the substrate, having a main metallic ground plane and a protruded metallic ground plane, the main metallic ground plane being rectangular or substantially rectangular shape with two adjacent corners thereof respectively cut off a 45° edge portion;

a first monopole antenna disposed on the first surface and excited by a first feeding port through a first 50-Ω microstrip line, the first monopole antenna being a straight radiating metallic line, extending outwardly at 90° on one of the cut edge portions of the main metallic ground plane; and a second monopole antenna disposed on the first surface and excited by a second feeding port through a second 50-Ω microstrip line, the second monopole antenna being a straight radiating metallic line, extending outwardly at 90° on the other of the cut edge portions of the main metallic ground plane.

9. The integrated dual-polarized printed monopole antenna as claimed in claim 8, wherein the first and the second monopole antennas are oriented symmetrically with respect to the protruded ground plane.

10. The integrated dual-polarized printed monopole antenna as claimed in claim 8, wherein the protruded metallic ground plane is rectangular or substantially rectangular, and wherein one side thereof extends from the main metallic ground plane between the two cut edge portions, and the length thereof is about 1.5 times of the first and second monopole antennas, and the width thereof is about 0.8 times of the first and second monopole antennas.

* * * * *